US009327388B2

(12) United States Patent
Chen

(10) Patent No.: US 9,327,388 B2
(45) Date of Patent: May 3, 2016

(54) RATCHET WRENCH WITH ANGLE ADJUSTING MECHANISM

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 222 days.

(21) Appl. No.: 14/303,610

(22) Filed: Jun. 13, 2014

(65) Prior Publication Data

US 2015/0360352 A1 Dec. 17, 2015

(51) Int. Cl.

| | |
|---|---|
| ***B25B 23/16*** | (2006.01) |
| ***B25B 13/46*** | (2006.01) |
| *B25B 23/00* | (2006.01) |
| *B25G 1/06* | (2006.01) |

(52) U.S. Cl.

CPC ..... *B25B 13/461* (2013.01); *B25G 1/063* (2013.01); *B25B 23/0028* (2013.01); *B25G 1/066* (2013.01)

(58) Field of Classification Search

CPC .. B25B 13/461; B25B 23/0028; B25G 1/063; B25G 1/066

USPC ..... 81/177.8, 177.9

See application file for complete search history.

(56) References Cited

U.S. PATENT DOCUMENTS 6,000,302 A * 12/1999 Chiang ..... B25G 1/063 81/177.7
6,886,429 B1 * 5/2005 Lee ..... B25B 13/461 81/177.7
7,000,507 B1 * 2/2006 Lin ..... B25G 1/063 81/177.7
7,165,480 B2 * 1/2007 Lin ..... B25G 1/063 81/177.9
7,174,815 B1 * 2/2007 Hsieh ..... B25G 1/063 403/93
7,874,262 B2 * 1/2011 Bohnheio ..... B05B 15/045 118/504
8,276,485 B1 * 10/2012 Chen ..... B25B 23/0028 81/135
8,850,932 B2 * 10/2014 Tsai ..... B25B 13/461 81/177.7
2004/0177731 A1 * 9/2004 Chen ..... B25G 1/063 81/177.8
2005/0268753 A1 * 12/2005 Lin ..... B25B 13/461 81/177.9
2009/0000430 A1 * 1/2009 Wu ..... B25B 23/0028 81/177.8
2011/0072941 A1 * 3/2011 Tsai ..... B25G 1/063 81/177.8
2014/0090523 A1 * 4/2014 Hsieh ..... B25G 1/063 81/177.9

* cited by examiner

*Primary Examiner* — Hadi Shakeri
*Assistant Examiner* — Danny Hong

(57) ABSTRACT

A ratchet wrench includes a handle, a driving head, an engaging member, a spring and a controlling knob. The handle has a receiving groove, a transverse hole in one lateral side of the handle, and a longitudinal hole in a bottom of the receiving groove. The driving head has a connecting portion pivotally connected to the handle. The engaging member is movably received in the longitudinal hole, and has a guiding cutout in a lateral side thereof. The spring is interposed between a bottom of the longitudinal hole and the engaging member. The controlling knob has an abutting block received in the guiding cutout of the engaging member. The abutting block is substantially oblong in shape such that rotational movement of the controlling knob drives the engaging member to be disengaged from the driving head.

7 Claims, 7 Drawing Sheets

RATCHET WRENCH WITH ANGLE ADJUSTING MECHANISM

BACKGROUND OF THE INVENTION

1. Field of the Invention

The present invention relates to a ratchet wrench and more particularly to a ratchet wrench with angle adjusting mechanism, in which an angle between a handle and a head member pivoted on the handle is adjustable.

2. Description of Related Art

A conventional ratchet wrench with angle adjusting mechanism has a handle and a driving head provided with a toothed protrusion. The handle has a forked end to receive the protrusion, wherein the head and the handle are hinged about a bolt therethrough. Between the tines of the fork is also disposed a gear having two different size diameters. This gear is provided on the shaft of a button which is spring loaded. In the normal position the large gear engages with the teeth of the protrusion on the head and the smaller gear engages with an inwardly toothed section of one tine of the fork such that the wrench head and handle are held rigid. When the button is depressed, the smaller gear disengages from the handle and the wrench head and handle are free to rotate with respect to each other. When the button is released, the spring loaded returns the gear to the normal position and the handle is fixed again.

However, the gear may not be completely engaged with and completely disengaged from the teeth of the driving head such that the rotational movement of the driving head may not be easily operated. In addition, a number of parts and elements are required and may not be easily assembled.

The present invention has arisen to mitigate and/or obviate the disadvantages of the conventional ratchet wrench.

SUMMARY OF THE INVENTION

The main objective of the present invention is to provide an improved ratchet wrench.

To achieve the objective, a ratchet wrench comprises a handle, a driving head, an engaging member, a spring and a controlling knob. The handle has a receiving groove defined in one end thereof, a transverse hole defined in one lateral side of the handle, and a longitudinal hole defined in a bottom of the receiving groove and in communication with the transverse hole. The driving head has a connecting portion received in the receiving groove of the handle and pivotally connected to the handle, the connecting portion has a plurality of teeth at an outer periphery thereof and arranged in an arc. The engaging member is movably received in the longitudinal hole of the handle, and has an engaging tooth at a top thereof for engagement with the teeth of the driving head, and a guiding cutout defined in a lateral side of the engaging member and corresponding to the transverse hole of the handle. The spring is interposed between a bottom of the longitudinal hole of the handle and the engaging member, and configured to bias the engaging member toward the driving head. The controlling knob passes through the transverse hole of the handle and in the guiding cutout of the engaging member, and has an abutting block at one end which is received in the guiding cutout of the engaging member. Specifically, the abutting block is substantially oblong in shape such that rotational movement of the controlling knob drives the engaging member to be disengaged from the driving head.

Preferably, the guiding cutout of the engaging member defines a large groove and a narrow groove communicating with the large groove; the narrow groove is disposed outside the large groove. The abutting block of the controlling knob is received in the large groove of the engaging member.

Preferably, the controlling knob has a rotary disc opposite to the abutting block, and a post connecting the rotary disc and the abutting block. The post passes through the transverse hole of the handle. The rotary disc is located outside the guiding cutout of the engaging member.

Preferably, the abutting block of the controlling knob has an oblong cross section with rounded corners. The teeth of the connecting portion of the driving head and the engaging tooth of the engaging member are substantially rectangular in shape.

Further benefits and advantages of the present invention will become apparent after a careful reading of the detailed description with appropriate reference to the accompanying drawings.

DETAILED DESCRIPTION OF THE INVENTION

Figure 1:
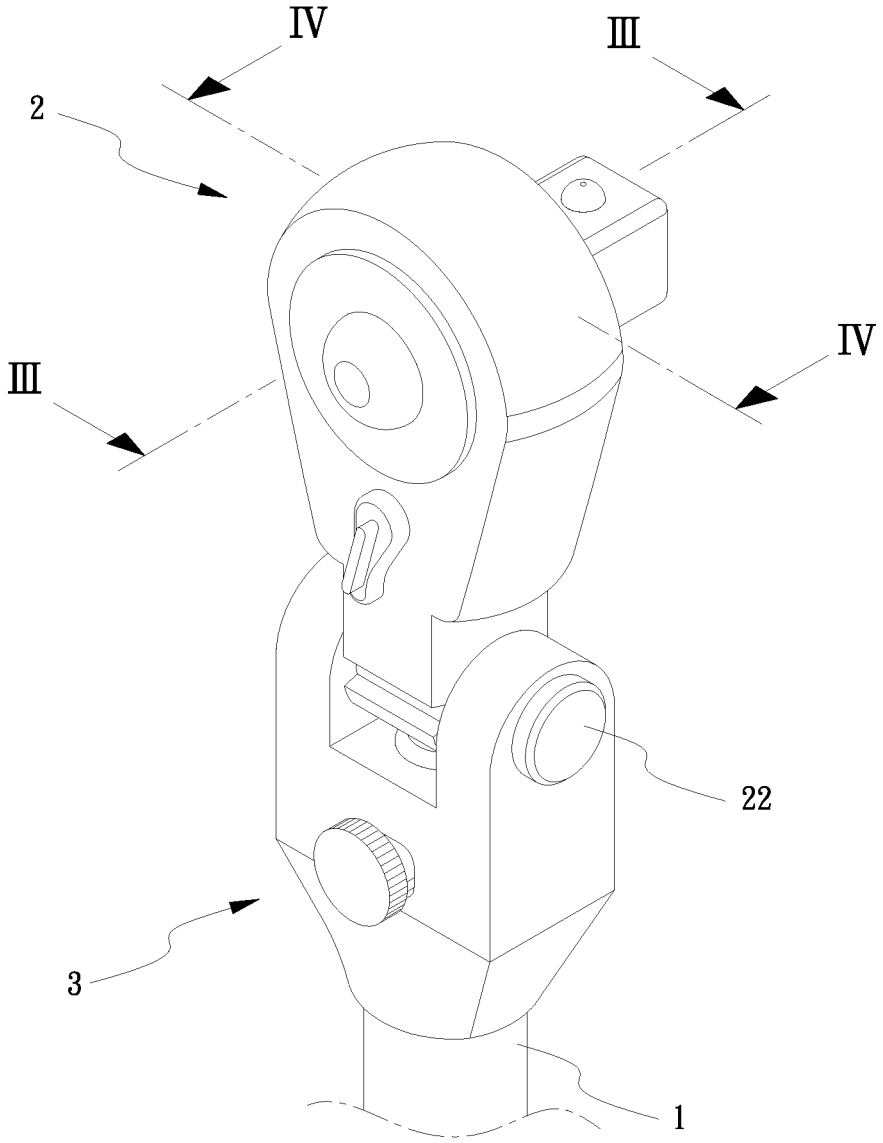
FIG. 1 is a perspective view of a ratchet wrench in accordance with a preferred embodiment of the present invention.
Figure 2:
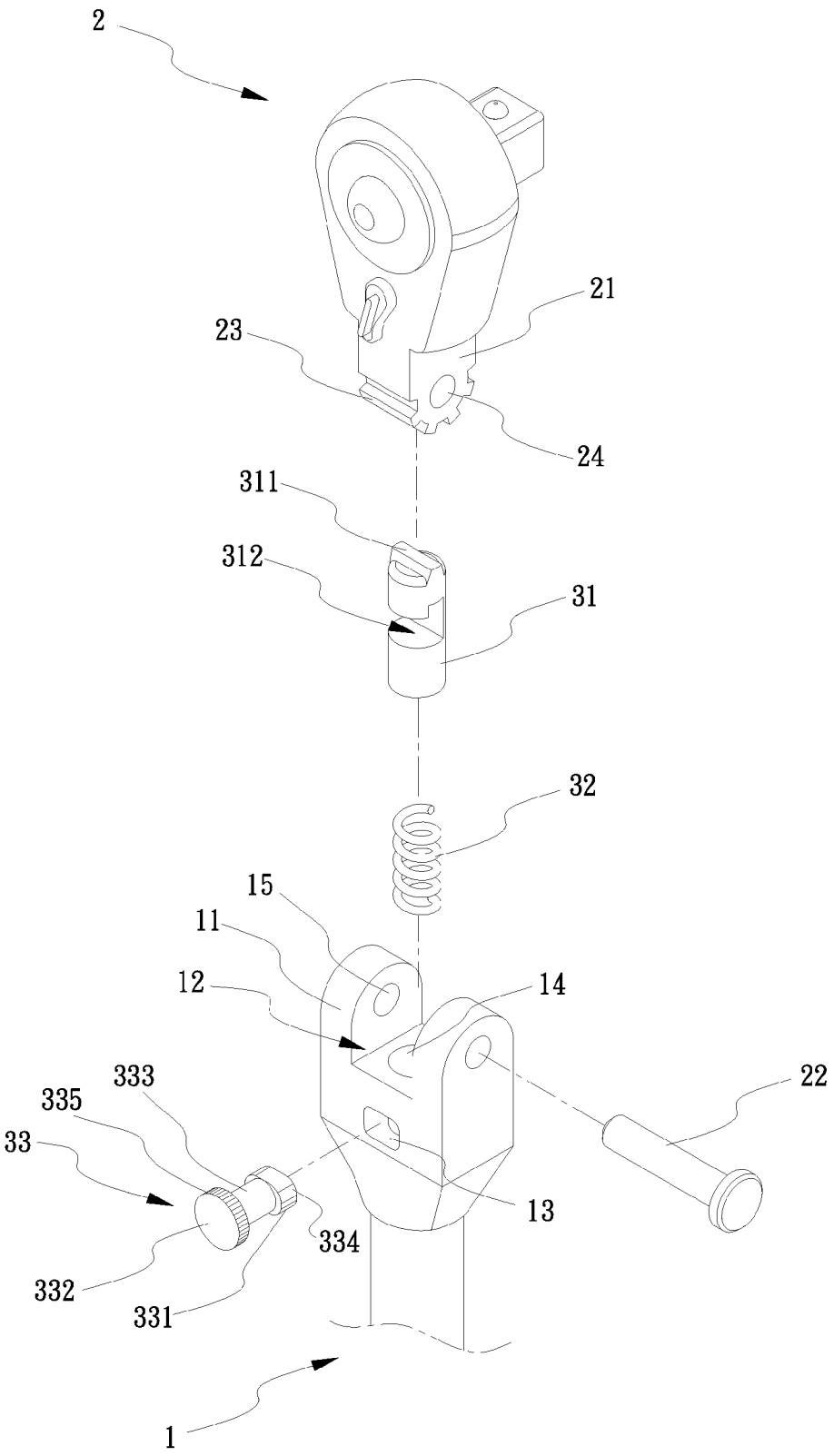
FIG. 2 is an exploded perspective view of the ratchet wrench shown in FIG. 1.
Figure 3:
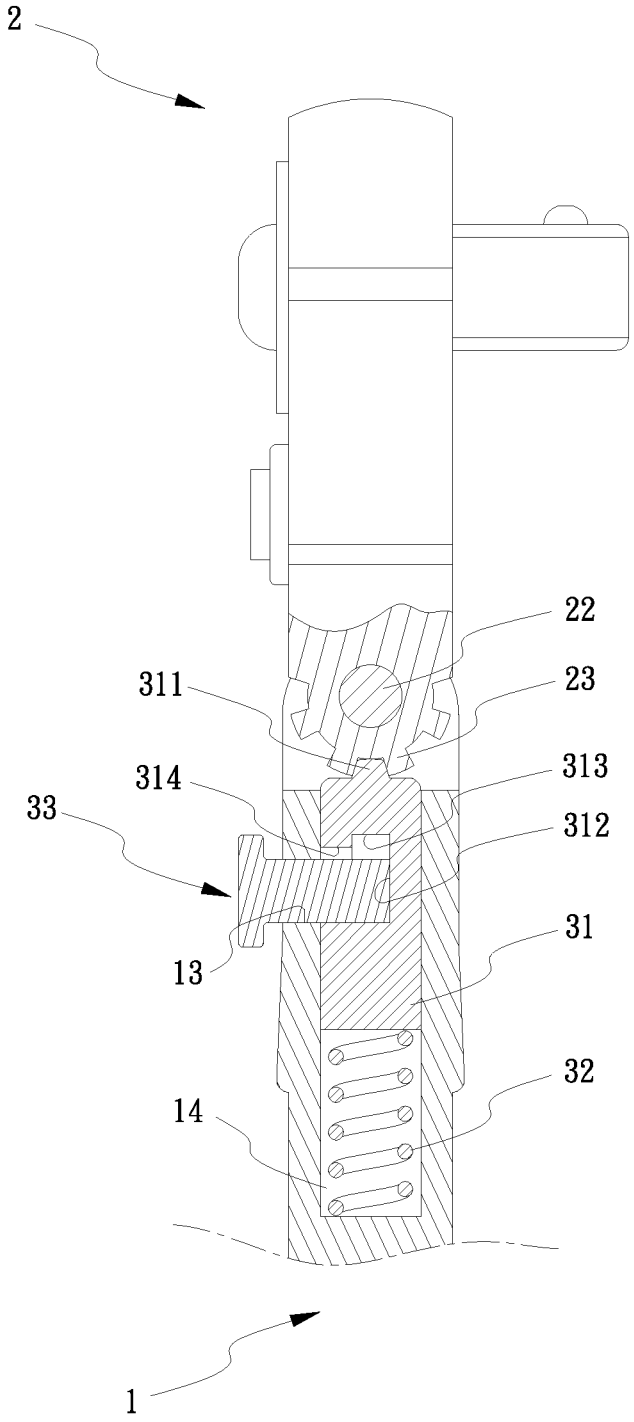
FIG. 3 is a partial cross-sectional view of the ratchet wrench along line III-III of FIG. 1.

Referring to FIGS. 1-3, a ratchet wrench with angle adjusting mechanism in accordance with a preferred embodiment of the present invention comprises a handle 1, a driving head 2 and an engaging assembly 3. The handle 1 has two pivot ears 11 at one end thereof, a receiving groove 12 defined between the two pivot ears 11, a transverse hole 13 defined in one lateral side of the handle 1, and a longitudinal hole 14 defined in a bottom of the receiving groove 12, wherein the transverse hole 13 communicates with the longitudinal hole 14. Each of the two pivot ears 11 has a through hole 15 therein. The driving head 2 has a connecting portion 21 received in the receiving groove 12 of the handle 1, and a connecting hole 24 defined therethrough. A pivot shaft 22 passes through the through hole 15 of each pivot ear 11 and the connecting hole 24 of the connecting portion 21 to secure the driving head 2 to the handle 1 such that the driving head 2 is rotatable relative to the handle 1.

The connecting portion 21 has a plurality of teeth 23 at an outer periphery thereof and arranged in an arc. The engaging assembly 3 comprises an engaging member 31, a spring 32 and a controlling knob 33. The engaging member 31 is movably received in the longitudinal hole 14 of the handle 1. The engaging member 31 has an engaging tooth 311 at a top thereof for engagement with the teeth 23 of the driving head 2 and a guiding cutout 312 defined in a lateral side of the engaging member 31. The guiding cutout 312 corresponds to the transverse hole 13 of the handle 1. The spring 32 is interposed between a bottom of the longitudinal hole 14 of the handle 1 and the engaging member 31, which is configured to bias the engaging member 31 toward the driving head 2. The controlling knob 33 passes through the transverse hole 13 of the handle 1 and in the guiding cutout 312 of the engaging member 31. The controlling knob 33 has an abutting block 331 at one end thereof which is received in the guiding cutout 312 of the engaging member 31. Specifically, the abutting block 331 is substantially oblong in shape such that rotational movement of the controlling knob 33 drives the engaging member 31 to be disengaged from the driving head 2.

Referring to FIGS. 2-3, the guiding cutout 312 of the engaging member 31 is substantially L-shaped, which defines a large groove 313 and a narrow groove 314 communicating with the large groove 313. The narrow groove 314 is disposed outside the large groove 313. The controlling knob 33 has a rotary disc 332 opposite to the abutting block 331, and a post 333 connecting the rotary disc 332 and the abutting block 331. The post 333 passes through the transverse hole 13 of the handle 1 and into the guiding cutout 312 such that the abutting block 331 of the controlling knob 33 is received and restricted within the large groove 313 of the engaging member 31. The rotary disc 332 is located outside the guiding cutout 312 of the engaging member 31.

Figure 5:
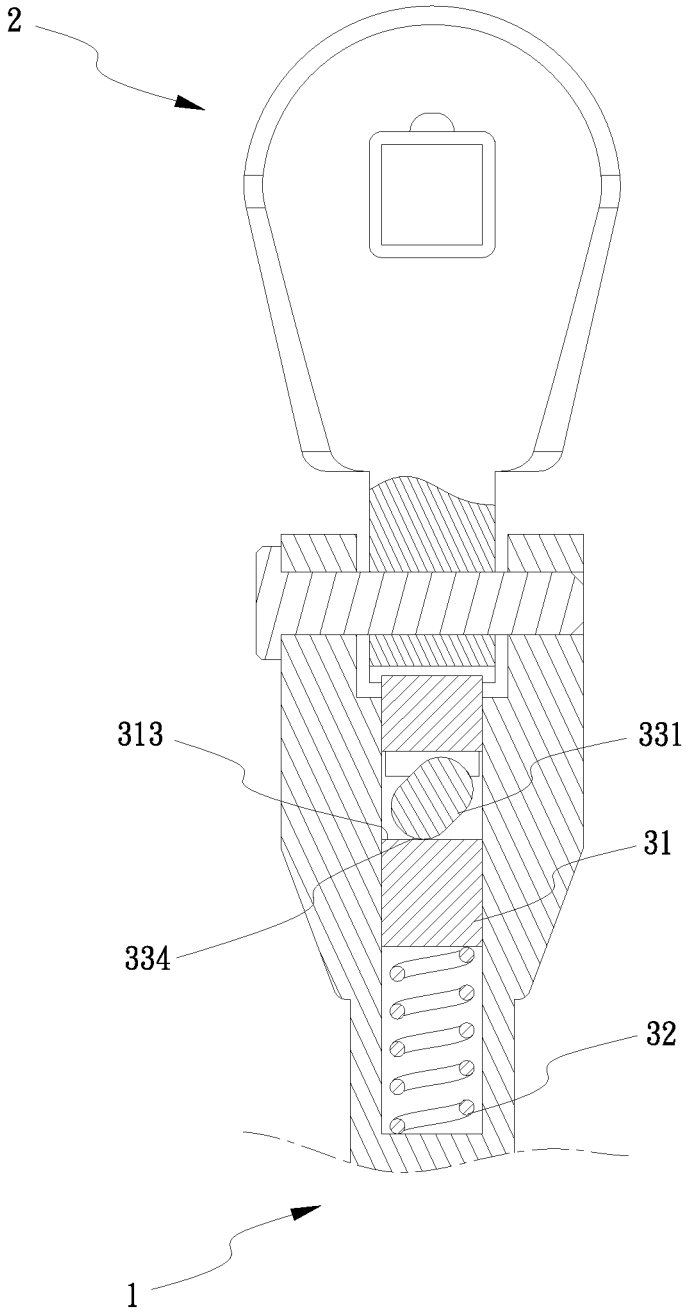
FIG. 5 illustrates that the abutting block of the controlling knob is rotated to drive the engaging member to move longitudinally relative to the driving head.

Furthermore, the abutting block 331 of the controlling knob 33 has an oblong cross section with rounded corners 334 for rotating smoothly, as shown in FIG. 5. In addition, the rotary disc 332 of the controlling knob 33 has a non-slip texture 335 disposed at an outer periphery thereof. Each of the teeth 23 of the connecting portion 21 of the driving head 2 and the engaging tooth 311 of the engaging member 31 are substantially rectangular in shape for stable engagement.

Figure 4:
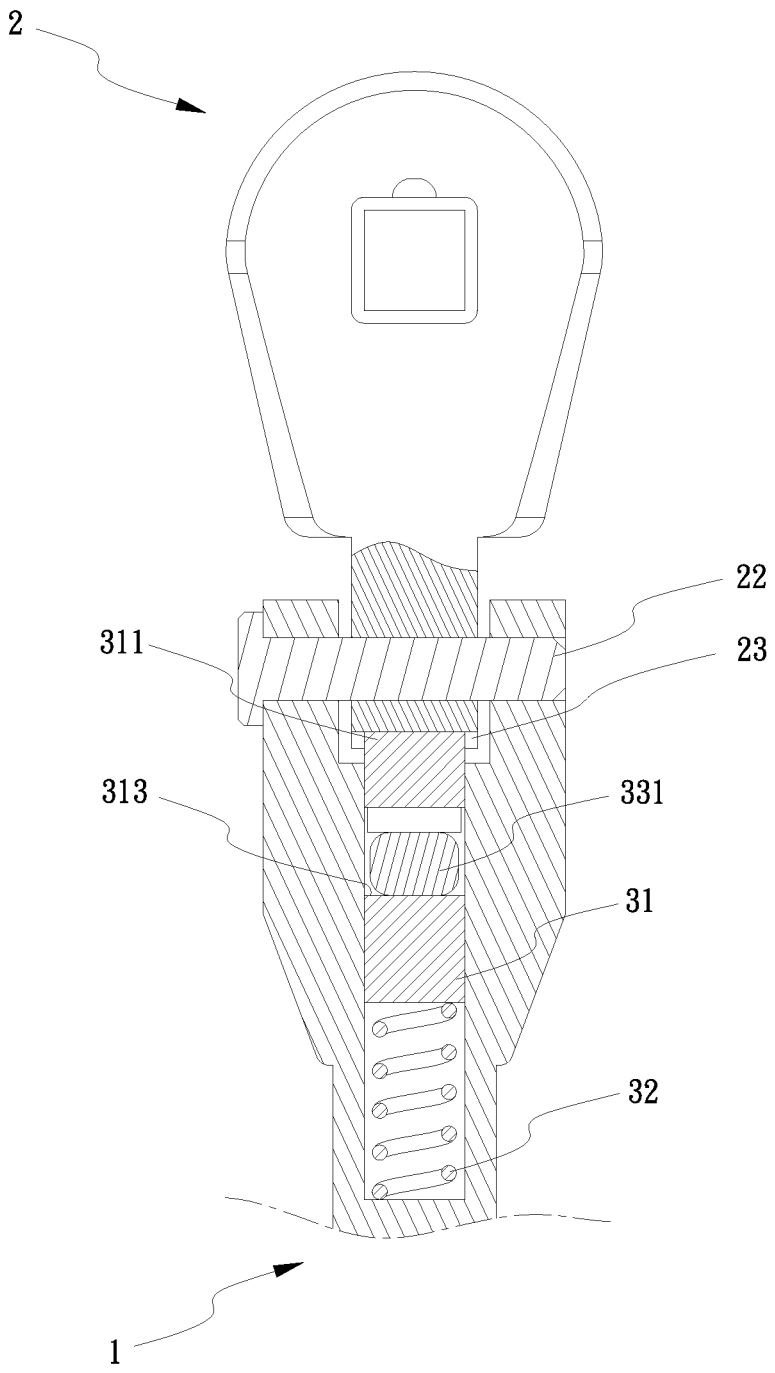
FIG. 4 is another partial cross-sectional view of the ratchet wrench along line IV-IV of FIG. 1.
Figure 6:
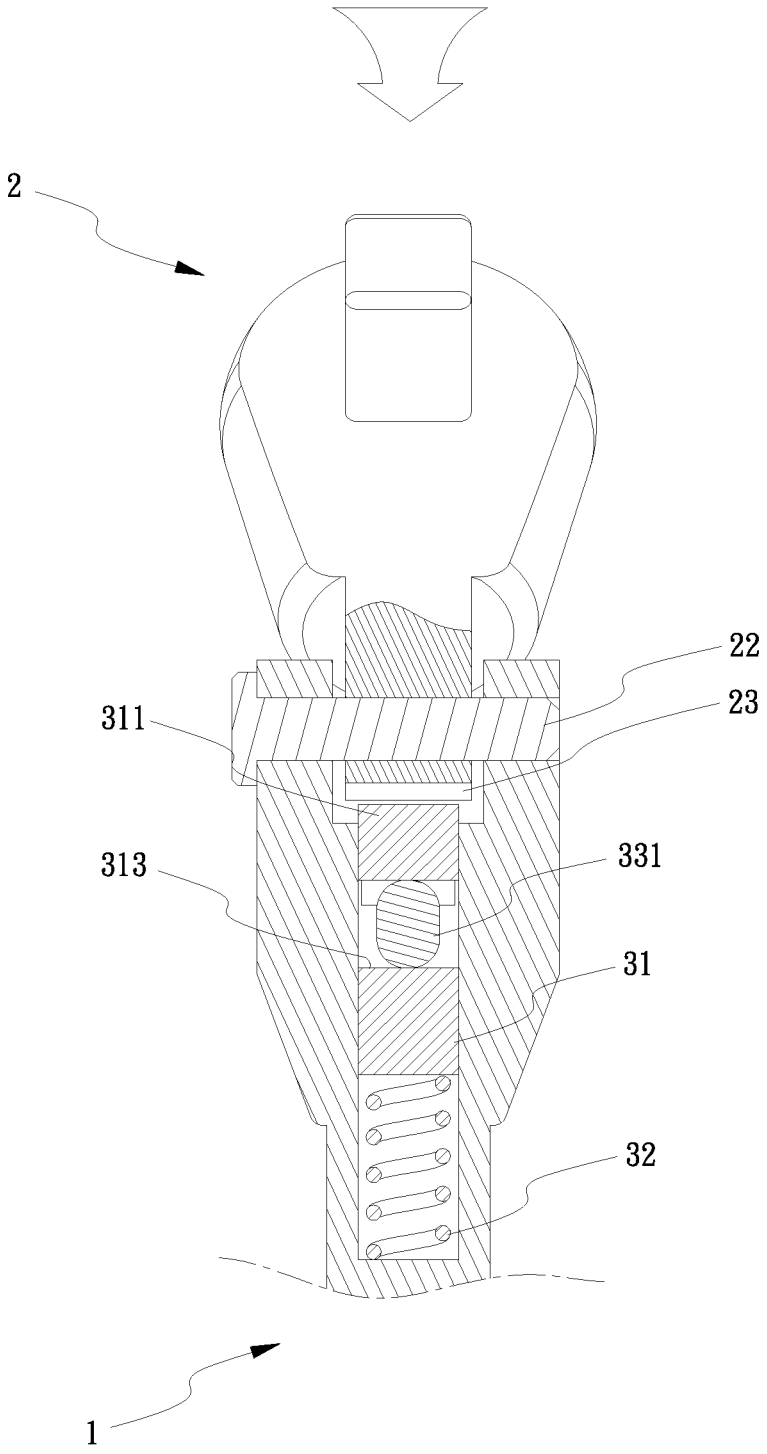
FIGS. 6-7 illustrates that the driving head is rotatable relative to the handle as the engaging member disengaged from the driving head.

Referring to FIGS. 3-4, the engaging tooth 311 of the engaging member 31 is generally engaged with the teeth 23 of the driving head 2 via the elastic force of the spring 32 so as to retain the driving head 2 on the handle 1. The abutting block 331 of the controlling knob 33 is oblong in shape such that the abutting block 331 has two opposite long sides and two opposite short sides. Under this arrangement, the abutting block 331 could be rotated to a first position where the abutting block 331 abuts against a wall of the guiding cutout 312 of the engaging member 31 with one of the two long sides as shown in FIG. 4, and a second position wherein the abutting block 331 abuts against the wall of the guiding cutout 312 with one of the two short sides as shown in FIG. 6.

Figure 7:
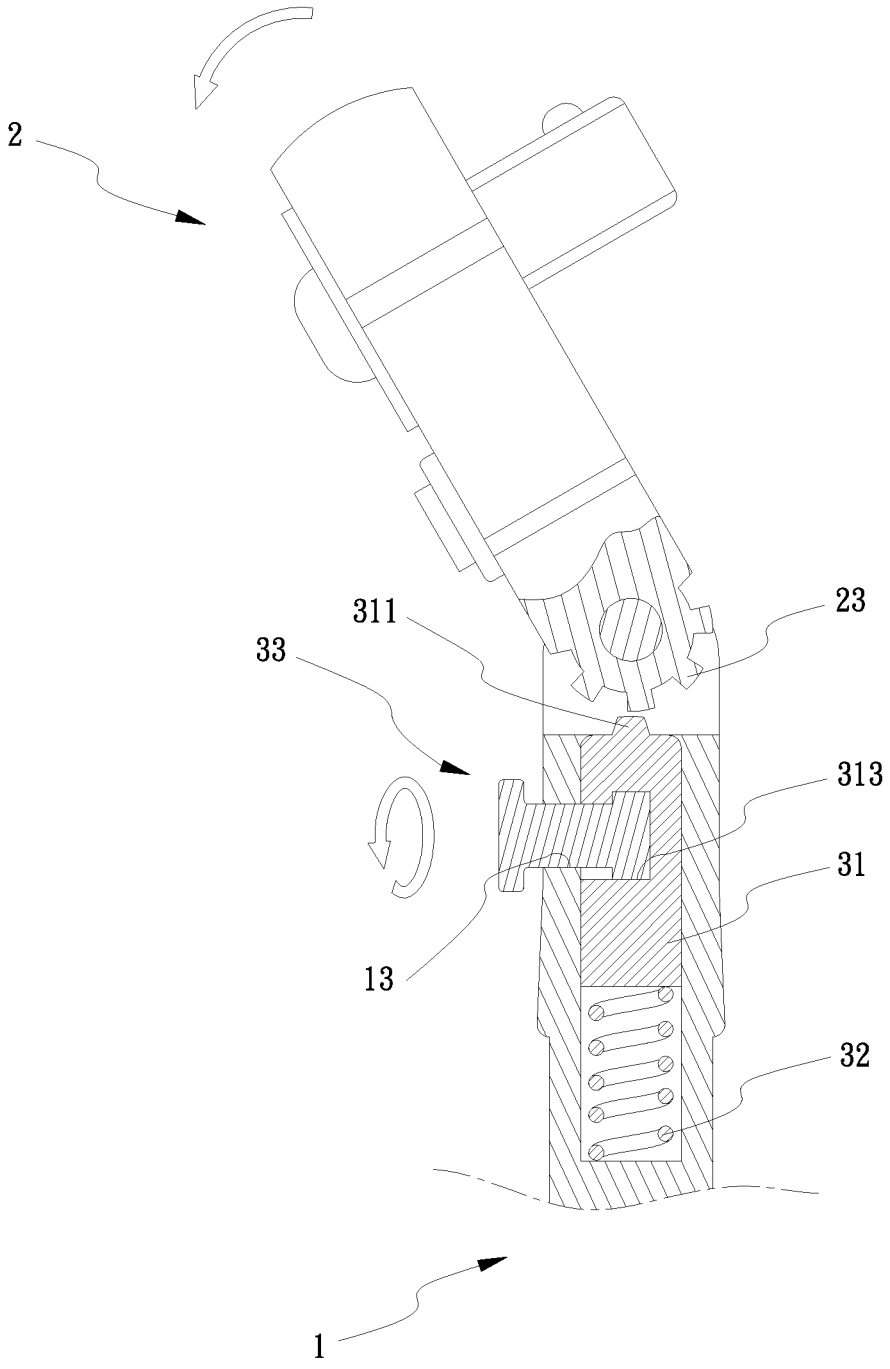

The detail descriptions of the operation are shown as following. Generally, the spring 32 abuts against the engaging member 31 toward the driving head 2 such that the engaging tooth 311 of the engaging member 31 is engaged with the teeth 23 of the connecting portion 21 to secure the driving head 2 while the abutting block 331 is arranged in the first position, as shown in FIGS. 3-4. Referring to FIGS. 5-7, when the controlling knob 33 is rotated, the abutting block 331 abuts against a wall of the large groove 313 of the guiding cutout 312 such that the engaging member 31 is moved downwardly along the longitudinal hole 14 of the handle 1 to be disengaged from the driving head 2 while the spring 32 is biased. Therefore, an angle of the driving head 2 could be adjusted relative to the handle 1. In contrast, when the controlling knob 33 is further rotated, the engaging member 31 is pushed by the spring 32 via the recovery force while the engaging tooth 311 of the engaging member 31 is engaged with the teeth 23 of the driving head 2 again to secure the driving head 2 in an appropriate angle while the abutting block 331 is arranged in the second position.

What is claimed is:

1. A ratchet wrench, comprising:

a handle having a receiving groove defined in one end thereof, a transverse hole defined in one lateral side of the handle, and a longitudinal hole defined in a bottom of the receiving groove and in communication with the transverse hole;

a driving head having a connecting portion received in the receiving groove of the handle and pivotally connected to the handle, the connecting portion having a plurality of teeth at an outer periphery thereof and arranged in an arc;

an engaging member movably received in the longitudinal hole of the handle, and having an engaging tooth at a top thereof for engagement with the teeth of the driving head, and a guiding cutout defined in a lateral side of the engaging member and corresponding to the transverse hole of the handle;

a spring interposed between a bottom of the longitudinal hole of the handle and the engaging member, and configured to bias the engaging member toward the driving head; and a controlling knob passing through the transverse hole of the handle and in the guiding cutout of the engaging member, and having an abutting block at one end which is received in the guiding cutout of the engaging member, the abutting block being substantially oblong in shape such that rotational movement of the controlling knob drives the engaging member to be disengaged from the driving head.

2. The ratchet wrench as claimed in claim 1, wherein the guiding cutout of the engaging member defines a large groove and a narrow groove communicating with the large groove; the narrow groove is disposed outside the large groove; and the abutting block of the controlling knob is received in the large groove of the engaging member.

3. The ratchet wrench as claimed in claim 1, wherein the controlling knob has a rotary disc opposite to the abutting block, and a post connecting the rotary disc and the abutting block; the post passes through the transverse hole of the handle; and the rotary disc is located outside the guiding cutout of the engaging member.

4. The ratchet wrench as claimed in claim 1, wherein the abutting block of the controlling knob has an oblong cross section with rounded corners.

5. The ratchet wrench as claimed in claim 3, wherein the rotary disc of the controlling knob has a non-slip texture disposed at an outer periphery thereof.

6. The ratchet wrench as claimed in claim 1, wherein each of the teeth of the connecting portion of the driving head is substantially rectangular in shape.

7. The ratchet wrench as claimed in claim 1, wherein the engaging tooth of the engaging member is substantially rectangular in shape.

* * * * *